US010046382B2

(12) United States Patent
Zhao et al.

(10) Patent No.: US 10,046,382 B2
(45) Date of Patent: Aug. 14, 2018

(54) SYSTEM AND METHOD FOR FORMING A LOW ALLOY STEEL CASTING

(71) Applicant: General Electric Company, Schenectady, NY (US)

(72) Inventors: Qi Zhao, Niskayuna, NY (US); Steven Robert Hayashi, Niskayuna, NY (US); Brian Victor Moore, Niskayuna, NY (US); Daniel Tribeni Persaud, Schenectady, NY (US); Michael Douglas Arnett, Simpsonville, SC (US); Junyoung Park, Greer, SC (US)

(73) Assignee: General Electric Company, Schenectady, NY (US)

( * ) Notice: Subject to any disclaimer, the term of this patent is extended or adjusted under 35 U.S.C. 154(b) by 595 days.

(21) Appl. No.: 14/081,116

(22) Filed: Nov. 15, 2013

(65) Prior Publication Data

US 2015/0139850 A1 May 21, 2015

(51) Int. Cl.
*B22C 7/02* (2006.01)
*B22C 9/04* (2006.01)
(Continued)

(52) U.S. Cl.
CPC ..... *B22C 9/046* (2013.01); *B22C 7/023* (2013.01); *B22C 9/00* (2013.01); *B22D 25/00* (2013.01); *B22D 29/00* (2013.01)

(58) Field of Classification Search
CPC .. B22C 7/02; B22C 7/023; B22C 9/00; B22C 9/04; B22C 9/046; B22D 25/00; B22D 29/00
(Continued)

(56) References Cited

U.S. PATENT DOCUMENTS 3,498,360 A 3/1970 Wittmoser et al.
4,773,466 A 9/1988 Cannarsa et al.
(Continued)

FOREIGN PATENT DOCUMENTS

CN 101767186 A 7/2010
CN 102389941 A 3/2012
(Continued)

OTHER PUBLICATIONS

"Lost Foam Casting", Foseco Ferrous Foundryman's Handbook—Chapter 15, 2000, pp. 216-225.
(Continued)

*Primary Examiner* — Kevin P Kerns
(74) *Attorney, Agent, or Firm* — GE Global Patent Operation; John Darling

(57) ABSTRACT

A method of casting a low alloy steel using a mold is disclosed. The method includes receiving the mold having a foam pattern disposed within a sand casing. The received foam pattern is coated with a permeable refractory coating and is disposed between compacted sand and the sand casing. The method further includes pouring a molten metal comprising a low alloy steel having a carbon content in a range from about 0.1 to about 0.4 percent into the mold so as to vaporize the foam pattern and remove gasification products through the permeable refractory coating, to form a low alloy steel casting. Further, the method includes removing the low alloy steel casting from the mold.

13 Claims, 3 Drawing Sheets

(51) Int. Cl.
*B22D 25/00* (2006.01)
*B22D 29/00* (2006.01)
*B22C 9/00* (2006.01)

(58) Field of Classification Search
USPC ..... 164/34, 45, 131
See application file for complete search history.

(56) References Cited

U.S. PATENT DOCUMENTS

| | | | | |
|---|---|---|---|---|
| 4,865,112 | A * | 9/1989 | Schwarb et al. | B22D 19/00 164/108 |
| 4,999,385 | A | 3/1991 | McCullough, Jr. et al. | |
| 5,041,465 | A | 8/1991 | Sonnenerg | |
| 5,053,437 | A | 10/1991 | Moll et al. | |
| 5,385,698 | A | 1/1995 | Bishop et al. | |
| 5,429,172 | A | 7/1995 | Hand | |
| 5,547,521 | A * | 8/1996 | Hand | B22C 9/046 148/522 |
| 5,755,271 | A * | 5/1998 | Williamson | B22C 9/04 164/34 |
| 6,263,950 | B1 | 7/2001 | Jones | |
| 6,303,664 | B1 | 10/2001 | Sonnenberg et al. | |
| 6,619,373 | B1 | 9/2003 | Tooley et al. | |
| 6,883,580 | B1 | 4/2005 | Donahue et al. | |
| 6,901,989 | B1 | 6/2005 | Sargent et al. | |
| 6,957,685 | B1 | 10/2005 | Donahue et al. | |
| 6,971,437 | B1 | 12/2005 | Cossey | |
| 7,025,109 | B1 | 4/2006 | Ward et al. | |
| 7,150,307 | B1 | 12/2006 | Goettsch | |
| 7,213,634 | B1 * | 5/2007 | Evans et al. | B22D 18/04 164/133 |
| 7,347,905 | B1 | 3/2008 | Donahue et al. | |
| 2004/0244934 | A1 * | 12/2004 | Narushima et al. | B22C 9/046 164/34 |
| 2005/0011625 | A1 | 1/2005 | Goettsch et al. | |

FOREIGN PATENT DOCUMENTS

| | | | | |
|---|---|---|---|---|
| CN | 103071761 | A | 5/2013 | |
| CN | 103084542 | A | 5/2013 | |
| JP | 01284456 | A | 11/1989 | |
| JP | 2854814 | B2 * | 2/1999 | B22C 7/02 |
| JP | 2003053478 | A | 2/2003 | |

OTHER PUBLICATIONS

Ainsworth, "Metal-Foam Interface Stability During the Filling of Lost Foam Moulds with Aluminium Alloys", A Doctoral Thesis—The University of Birmingham, Sep. 2010, 278 Pages.

"Foamcast® Lost Foam Casting Process Presentation", Foamcast, Product Catalogue, Downloaded from http://www.foamcast.in/uploads/4/5/2/1/4521329/foamcast_process_presentation.pdf on Jul. 15, 2013, 12 Pages.

A Design Study in Nickel-Based Superalloy Castings—Combustor Floatwall Panel; "Lost Foam Casting"; Downloaded from the Internet:<http://www.sfsa.org/tutorials/panel/float_07.htm>; on Oct. 18, 2013; p. 12.

GB Search Report and Written Opinion issued in connection with corresponding GB Application No. GB1419306.4 dated Dec. 19, 2014.

* cited by examiner

SYSTEM AND METHOD FOR FORMING A LOW ALLOY STEEL CASTING

BACKGROUND

The present disclosure relates generally to casting, and more particularly, to a lost foam casting of a low alloy steel having carbon content in a range from about 0.1 to about 0.4 percent.

Generally, sand casting requires a plurality of cores for casting complex structure such as turbine shells, turbochargers, crankcases, blowers and the like. The usage of plurality of cores increases material and labor cost, and may also result in long lead time in casting.

Lost foam casting may be used to address the problems related to cost and lead time. However, the casting obtained through the lost foam casting may have excessive carbon content. Further, the lost foam casting uses green bonded sand as backup medium within a sand casing, which may produce gaseous product or bubbles when a molten metal is poured into the mold, thereby entrapping the gaseous product within the casting. The carbon pickup and gas entrapment in the lost foam steel casting are caused due to incomplete foam removal before the molten metal solidifies within the mold. The retained foam generates carbon black and the entrapped gases redistributed inside the casting causes generation of higher local carbon content than the required limit.

Further, the molten metal poured in the mold may also react with the green bonded sand resulting in the fusion of the sand to the casting, thereby creating sand burns which may degrade the surface of the casting. The process of removal of the sand burns from the casting may further add to the process cost.

Thus, there is a need for an enhanced casting process for producing a low alloy steel having a very low carbon content.

BRIEF DESCRIPTION

In accordance with one exemplary embodiment, a method of casting a low alloy steel is disclosed. The method includes receiving a mold having a foam pattern provided with a permeable refractory coating. The foam pattern is disposed within a sand casing and compacted sand is disposed between the foam pattern and the sand casing. The method further includes pouring a molten metal including a low alloy steel having a carbon content in a range from about 0.1 to about 0.4 percent, into the mold so as to vaporize the foam pattern to form a low alloy steel casting. Further, the method includes removing a gasification product through the permeable refractory coating during the casting process. The method further includes removing the low alloy steel casting from the mold.

In accordance with another exemplary embodiment, a mold is disclosed. The mold includes a sand casing filled with compacted sand. Further, the mold includes a foam pattern having a cavity, disposed in the sand casing such that the compacted sand is disposed between the foam pattern and the sand casing. The foam pattern includes a permeable refractory coating having a permeability in a range from about 10 to about 100 $\mu m^2$ and a permeance in a range from about 2000 to about 24000 $\mu m^3$. The compacted sand has a permeability in a range from about 100 to about 1000 $\mu m^2$. The foam pattern has a bulk density in a range from about 13 to about 28 $kg/m^3$ and a surface density in a range from about 13 to about 35 $kg/m^3$.

In accordance with yet another exemplary embodiment, a method of manufacturing a mold and casting a low alloy steel using the mold is disclosed. The method includes forming a foam pattern having a cavity and applying a permeable refractory coating on the foam pattern. Further, the method includes disposing the foam pattern within a sand casing and filling unbonded sand between the foam pattern and the sand casing. The method further includes compacting the unbonded sand to form compacted sand so as to generate the mold. Further, the method includes pouring a molten metal into the mold to vaporize the foam pattern so as to form the low alloy steel casting. The method further includes removing a gasification product through the permeable refractory coating during casting. The molten metal includes the low alloy steel having a carbon content in a range from about 0.1 to about 0.4 percent. Further, the method includes removing the low alloy steel casting from the mold.

DRAWINGS

These and other features and aspects of embodiments of the present disclosure will become better understood when the following detailed description is read with reference to the accompanying drawings in which like characters represent like parts throughout the drawings, wherein.

Figure 1:
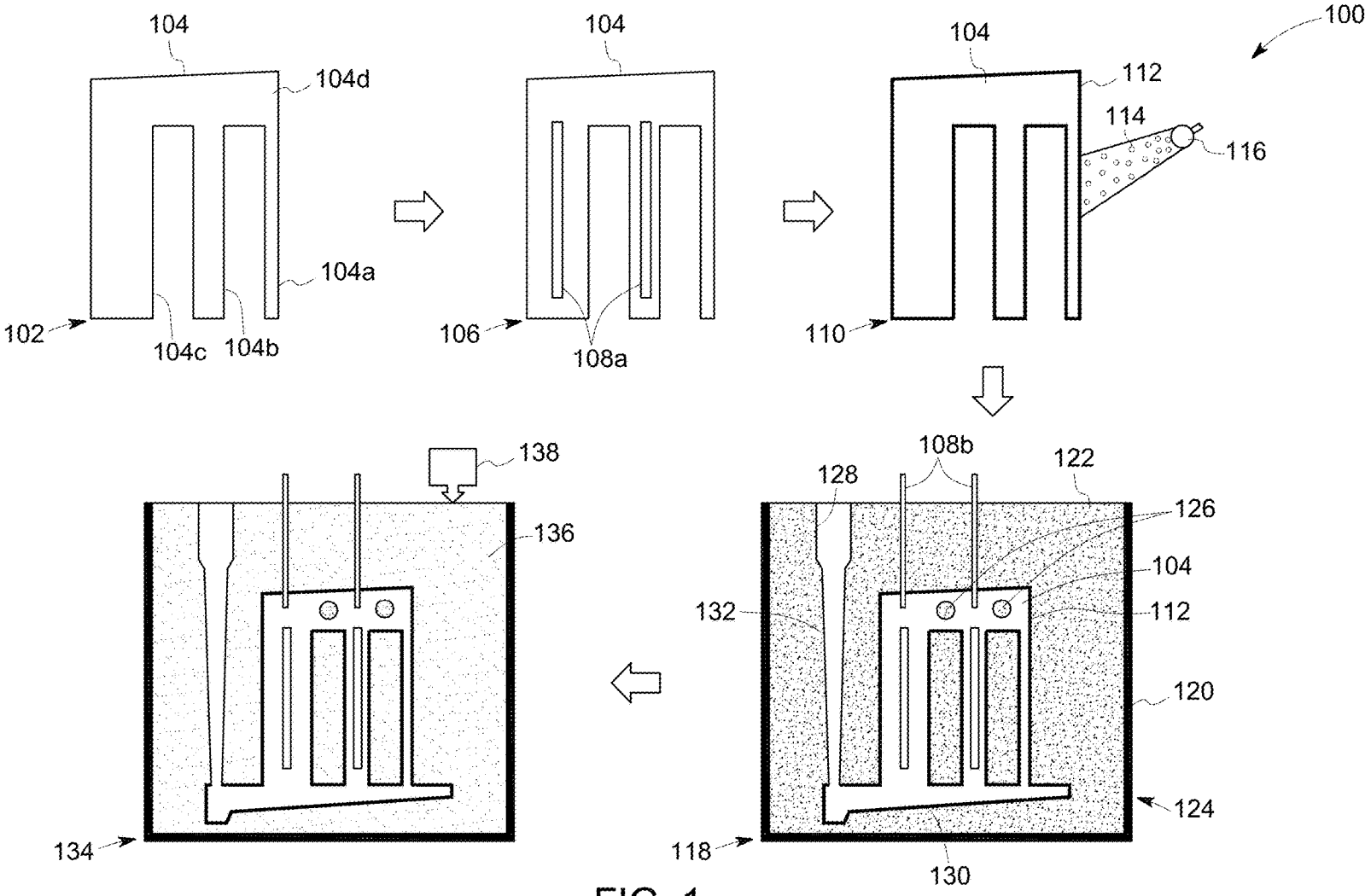
FIG. 1 is a schematic flow diagram illustrating a method of manufacturing a mold in accordance with an exemplary embodiment.
Figure 2:
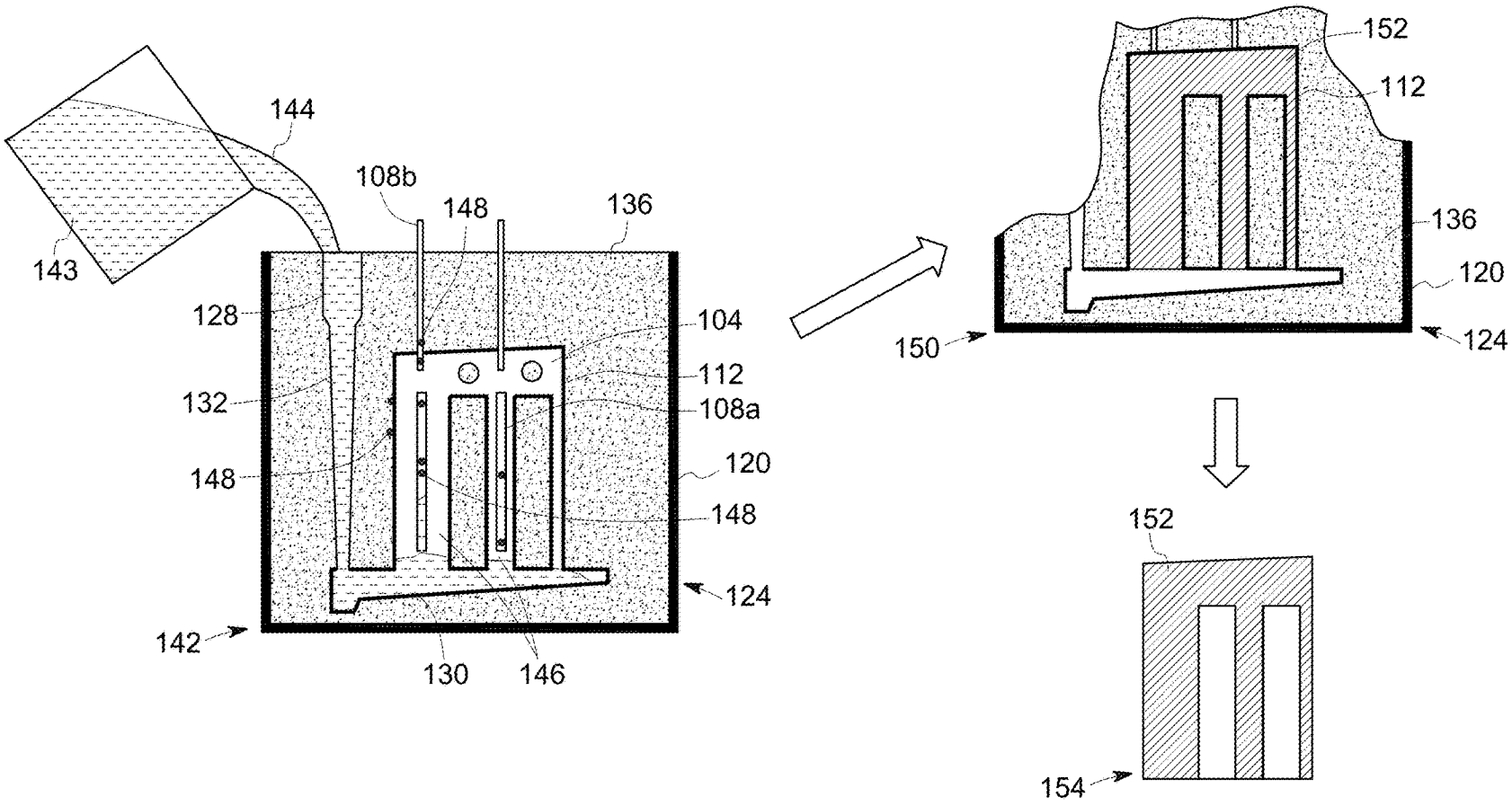
FIG. 2 is a schematic flow diagram illustrating a method of manufacturing a low alloy steel casting using the mold in accordance with the exemplary embodiment of FIG. 1.
Figures 3A, 3B:
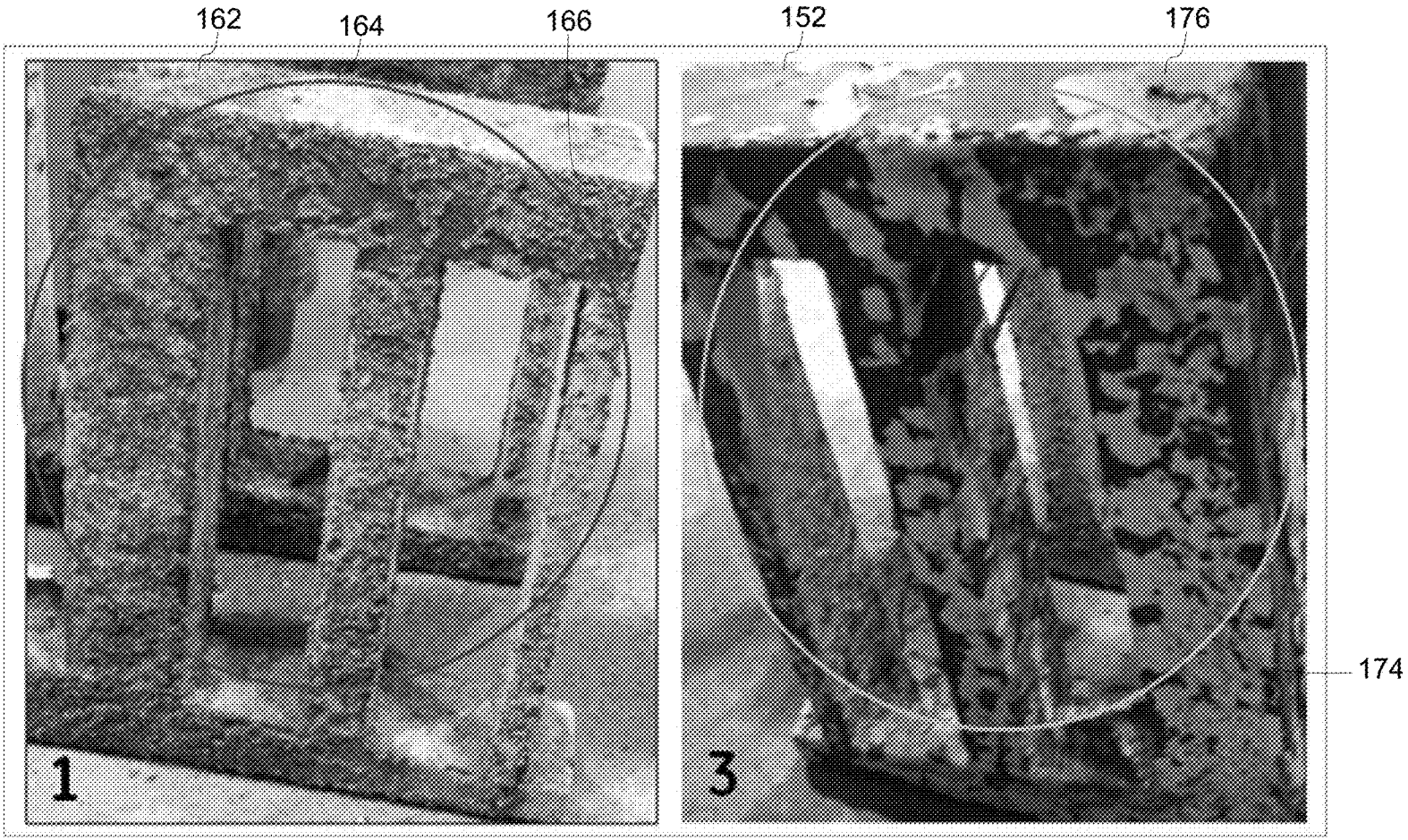
FIG. 3A (Prior Art)

FIG. 3*a* is a perspective view of an alloy steel casting manufactured using a conventional casting process; and FIG. 3*b* is a perspective view of a low alloy steel casting manufactured in accordance with the embodiments of FIGS. 1 and 2.

DETAILED DESCRIPTION

While only certain features of embodiments have been illustrated and described herein, many modifications and changes will occur to those skilled in the art. It is, therefore, to be understood that the appended claims are intended to cover all such modifications and changes as falling within the spirit of the invention.

Embodiments discussed herein disclose a method of casting a low alloy steel. More particularly, certain embodiments disclose receiving a mold having a foam pattern disposed between compacted sand and a sand casing. Further, the method includes pouring a molten metal of low alloy steel into the mold so as to vaporize the foam pattern to form a low alloy steel casting. The method further includes removing the low alloy steel casting from the mold.

More particularly, certain embodiments disclose a method of manufacturing a mold. The method includes forming a foam pattern having a cavity and applying a permeable refractory coating on the foam pattern. Further, the method includes disposing the foam pattern within a sand casing and filling unbonded sand between the foam pattern and the sand casing, to form the mold. Further, the method includes compacting the unbonded sand to form compacted sand within the mold.

FIG. 1 a schematic flow diagram illustrating a method 100 of manufacturing a mold 124 in accordance with an exemplary embodiment. The method 100 includes a step 102 of forming a foam pattern 104 by machining a solid block of a foam material, for example. In some other embodiments, the foam pattern 104 may be formed by injection molding, or the like. The foam material has a bulk density in a range from about 13 to about 28 kg/m$^3$ and a surface density in a range from about 13 to about 50 kg/m$^3$. A bulk density of the foam pattern 104 may be defined as mass of plurality of particles per total volume occupied by the foam pattern 104. A surface density of the foam pattern 104 may be defined as mass per unit area of the foam pattern 104. The foam pattern 104 having the bulk density in the aforementioned range enables dimensional integrity, controllable fill rate of a molten metal, and removal of a gasification product from the foam pattern 104. The foam pattern 104 having the surface density in the aforementioned range provides controlling a sequence of filling the molten metal into a cavity of the mold 124.

The foam material includes at least one of a polystyrene, a polymethylmethacrylate, and a polystyrene and polymethylmethacrylate copolymer material. In one embodiment, the process of forming the foam pattern 104 may include the step of injecting pre-expanded beads of the foam material into a preheated mold (not shown in FIG. 1) at a low pressure. Further, the preheated mold has a shape of the foam pattern and may be made of aluminum material or the like. The process further may include applying steam to the pre-expanded beads within the preheated mold form the foam pattern 104 of desired shape.

In the illustrated embodiment, the foam pattern 104 has three legs 104*a*, 104*b*, 104*c* and a body 104*d* connecting the legs 104*a*-104*c*. The foam pattern 104 shown in the embodiment is for illustration purpose only and should not be construed as a limitation of the invention.

The method 100 further includes a step 106 of forming a plurality of venting ports 108*a* in the foam pattern 104. Each venting port 108*a* removes a gasification product from the foam pattern 104 during a casting process. The method 100 further includes a step 110 of applying a permeable refractory coating 112 on the foam pattern 104. The step 110 further includes a step of preparing a permeable refractory coating material 114 having a predefined rheology. The permeable refractory coating material 114 includes an inorganic binder and a back bond material including alumina and/or zircon.

In one embodiment, the permeable refractory coating 112 is applied on the foam pattern 104 by dipping process or flow-coating process. The dipping process may include dipping the foam pattern 104 in a container (not shown in FIG. 1) having a slurry of the permeable refractory coating material 114 and then drying so as to form the permeable refractory coating 112 on the foam pattern 104. The flow-coating process may include using a flow-coating device 116 to spray the permeable refractory coating material 114 on the foam pattern 104 to form the permeable refractory coating 112. The flow-coating device 116 sprays the permeable refractory coating material 114 at a low shear rate so as to prevent damages to the foam pattern 104. The permeable refractory coating material 114 having the predefined rheology facilitates the dip-coating and the flow-coating of the foam pattern 104.

The permeable refractory coating 112 has a permeability in a range from about 10 to about 100 μm$^2$ and a permeance in a range from about 2000 to about 24000 μm$^2$. Permeability may be defined as an ability of the coating 112 to allow the gasification product to flow through the permeable refractory coating 112. Permeance may be defined as a product of permeability and thickness of the permeable refractory coating 112. The permeable refractory coating 112 having the permeability in the aforementioned range enables preventing metal penetration to obtain a desired surface finish of a low alloy steel casting (as shown in FIG. 3*b*). Similarly, the permeable refractory coating 112 having the permeance in the aforementioned range enables controllable fill rate of a molten metal and removal of the gasification product from the foam pattern 104.

The method 100 further includes a step 118 of disposing the foam pattern 104 within a sand casing 120 and filling unbonded sand 122 between the foam pattern 104 and the sand casing 120, to form a mold 124. In some embodiments, the sand casing 120 may include two halves which are clamped together to form the mold 124. The foam pattern 104 may be held within the sand casing 120 via a plurality of supports 126 so as to provide structural support and stability to the foam pattern 104. Further, a pouring basin 128, runner 130, and a riser 132 are coupled to the foam pattern 104. A molten metal is fed sequentially via the basin 128, the riser 132, and the runner 130 to the foam pattern 104. The mold 124 also includes a plurality of venting ports 108*b* extending from the foam pattern 104 to the atmosphere through the unbonded sand 122. The plurality of venting ports 108*b* is used to remove the gasification product from the foam pattern 104 during casting process. In one embodiment, the plurality of venting ports 108*b* is made of ceramic material. In the illustrated embodiment, the plurality of venting ports 108*b* are disposed downstream of the foam pattern 104 so as to enhance venting of the gasification product.

The method 100 further includes a step 134 of compacting the unbonded sand 122 disposed between the foam pattern 104 and the sand casing 120 to form a compacted sand 136. The compacting of the unbonded sand 122 is performed using a compaction device 138. In one embodiment, the compaction device 138 applies vibration of variable frequency and amplitude to the unbonded sand 122 so as to form the compacted sand 136. In another embodiment, the compaction device 138 applies vacuum force to the unbonded sand 122 to form the compacted sand 136. The compacted sand 136 has a permeability in a range from about 100 to about 2000 μm$^2$. The permeability of the compacted sand 136 in the aforementioned range enables controlling of integrity of the low alloy steel casting dimension and rate of removal of the gasification product from the foam pattern 104. The compacted sand 136 provides structural stability to the foam pattern 104 during the casting process. Further, the compacted sand 136 of the embodiment is dry in nature and does not contain binders or additives for binding and supporting the foam pattern 104.

FIG. 2 is a schematic flow diagram illustrating a method 140 of manufacturing a low alloy steel casting 152, using the mold 124 in accordance with the exemplary embodiment of FIG. 1.

The method 140 includes a step 142 of pouring a molten metal 144 into the mold 124 via the basin 128, the runner 130, and the riser 132. The molten metal 144 may be stored at high temperature and then poured from a ladle 143 to the mold 124. The molten metal 144 includes a low alloy steel having a carbon content in a range from about 0.1 to about 0.4 percent. In one embodiment, the molten metal 144 has a temperature in a range from about 2900 to about 3100 degrees Fahrenheit. Further, the molten metal 144 is fed at a rate from about 0.04 to about 0.8 kg/sec/cm$^2$. The feeding rate of the molten metal 144 in the aforementioned range enables complete removal of the foam pattern 104 from the mold 124 and also diligent removal of the gasification products 148 from the foam pattern 104. The temperature of the molten metal 144 in the aforementioned range enables complete vaporization of the foam pattern 104.

In one embodiment, the molten metal 144 at a temperature range from about 3000 to about 3100 degrees Fahrenheit is fed at a rate in a range from about 0.1 to about 0.8 kg/sec/cm$^2$ into a cavity 146 of the foam pattern 104. In such an embodiment, the foam pattern 104 includes a polystyrene and polymethylmethacrylate copolymer material having a bulk density in a range from about 16 to about 28 kg/m$^3$. In another embodiment, the molten metal 144 at a temperature range from about 2950 to about 3000 degrees Fahrenheit, is fed at a rate in a range from about 0.1 to about 0.3 kg/sec/cm$^2$ into the cavity 146 of the foam pattern 104. In such an embodiment, the foam pattern 104 includes a polystyrene material having a bulk density in a range from about 14 to about 20 kg/m$^3$. In yet another embodiment, the molten metal 144 at a temperature range from about 2900 to about 2950 degrees Fahrenheit, is fed at a rate in a range from about 0.04 to about 0.2 kg/sec/cm$^2$ into the cavity 146 of the foam pattern 104. In such an embodiment, the foam pattern 104 includes a polymethylmethacrylate material having a bulk density in a range from about 13 to about 18 kg/m$^3$.

The molten metal 144 vaporizes the foam pattern 104 and forms a gasification product 148. The gasification product 148 is removed through the permeable refractory coating 112 and the plurality of venting ports 108*a*, 108*b*. The permeable refractory coating 112 also prevents reaction of the molten metal 144 with the compacted sand 136 so as to avoid formation of sand burns. The method 140 further includes a step 150 of removing a low alloy steel casting 152 from the mold 124. At step 154, the low alloy steel casting 152 having a carbon content in the range from about 0.1 to about 0.4 percent and having a shape of the foam pattern 104 is obtained. The low alloy steel casting further has a carbon pick-up in a range from about 0.12 to about 0.16 percent, a surface defect (for example, sand burns) of less than 1 percent, and a gas entrapment of less than zero percent.

FIG. 3*a* is a perspective view an alloy steel casting 162 manufactured using a conventional casting process. The alloy steel casting 162 has a plurality of sand burns 164 formed on a surface 166 of the alloy steel casting 162. The sand burns 164 are formed due to reaction of molten metal with the green sand and generation of gas bubbles during the casting process.

FIG. 3*b* is a perspective view of a low alloy steel casting 152 manufactured in accordance with the exemplary embodiments of FIGS. 1 and 2. The low alloy steel casting 152 has relatively less sand burns 174 formed on the surface 176 of the low alloy steel 152. Further, the low alloy steel casting 152 is devoid of gas bubbles, core breakage, and sulfur pickups.

The exemplary lost foam casting process discussed herein provides required machined dimensions due to the elimination of a pattern draft angle, parting lines, and the ability to have dimensional tolerances. The utilization of unbonded dry sand reduces generation of gases and reaction with the molten metal having the carbon content in the range from about 0.1 to about 0.4 percent, resulting in formation of a casting having relatively reduced sand burns and entrapped gases within the casting. The type of foam material, flow rate and the temperature at which the molten metal is poured into the mold results in complete removal of the foam pattern from the mold resulting in formation of the casting having a reduced carbon content or pickup.

The invention claimed is:

1. A method comprising:

receiving a mold comprising a foam pattern provided with a permeable refractory coating, disposed within a sand casing, and compacted sand comprising unbonded sand, disposed between the foam pattern and the sand casing, wherein receiving the mold further comprises forming a plurality of venting ports in the foam pattern and through the unbonded sand disposed between the foam pattern and the sand casing, wherein the permeable refractory coating has a permeability in a range from about 10 to about 100 μm$^2$;

pouring a molten metal comprising a low alloy steel having a carbon content in a range from about 0.1 to about 0.4 percent, into the mold, resulting in vaporization of the foam pattern, removal of a gasification product through the permeable refractory coating, and prevention of penetration of the molten metal into the compacted sand through the permeable refractory coating, to form a low alloy steel casting; and removing the low alloy steel casting from the mold.

2. The method of claim 1, further comprising:

forming the foam pattern having a cavity;

preparing the permeable refractory coating material having a predefined rheology;

applying the permeable refractory coating material on the foam pattern to form the permeable refractory coating on the foam pattern; and disposing the foam pattern within the sand casing and filling the unbonded sand between the foam pattern and the sand casing and compacting the unbonded sand to form the compacted sand to support the foam pattern.

3. The method of claim 2, wherein the foam pattern comprises a foam material having a bulk density in a range from about 13 to about 28 kg/m$^3$.

4. The method of claim 2, wherein the foam pattern comprises a foam material having a surface density in a range from about 13 to about 50 kg/m$^3$.

5. The method of claim 2, wherein the foam pattern includes a foam material comprising at least one of a polystyrene, a polymethylmethacrylate, and a polystyrene and polymethylmethacrylate copolymer material.

6. The method of claim 2, wherein the permeable refractory coating comprises an inorganic binder and a back bond material including at least one of alumina and zircon.

7. The method of claim 2, wherein the applying comprises forming the permeable refractory coating on the foam pattern by dipping or flow-coating process.

8. The method of claim 2, wherein the compacted sand has a permeability in a range from about 100 to about 2000 μm$^2$.

9. The method of claim 2, wherein the permeable refractory coating has a permeance in a range from about 2000 to about 24000 μm$^3$, wherein the permeance is a product of the permeability and a thickness of the permeable refractory coating.

10. The method of claim 1, wherein the pouring comprises feeding the molten metal into a cavity of the foam pattern at a rate in a range from about 0.1 to about 0.8 kg/sec/cm$^2$, wherein the foam pattern comprises a polystyrene and polymethylmethacrylate copolymer material having a bulk density in a range from about 16 to about 28 kg/m$^3$.

11. The method of claim 1, wherein the pouring comprises feeding the molten metal into a cavity of the foam pattern at a rate in a range from about 0.1 to about 0.3 kg/sec/cm$^2$, wherein the foam pattern comprises a polystyrene material having a bulk density in a range from about 14 to about 20 kg/m$^3$.

12. The method of claim 1, wherein the pouring comprises feeding the molten metal into a cavity of the foam pattern at a rate in a range from about 0.04 to about 0.2 kg/sec/$cm^2$, wherein the foam pattern comprises a polymethylmethacrylate material having a bulk density in a range from about 13 to about 18 kg/$m^3$.

13. The method of claim 1, wherein the pouring comprises feeding the molten metal having a temperature in a range from about 2900 to about 3100 degrees Fahrenheit into a cavity of the foam pattern.

* * * * *